US005309128A

United States Patent [19]

Sebatier

[11] Patent Number: 5,309,128

[45] Date of Patent: May 3, 1994

[54] DEVICE FOR THE FILTERING OF ELECTROMAGNETIC WAVES PROPAGATING IN A ROTATIONAL SYMMETRICAL WAVEGUIDE, WITH INSERTED RECTANGULAR FILTERING WAVEGUIDE SECTIONS

[75] Inventor: M. Christian Sebatier, Nice, France

[73] Assignee: France Telecom, Paris, France

[21] Appl. No.: 904,348

[22] Filed: Jun. 25, 1992

[30] Foreign Application Priority Data

Jun. 26, 1991 [FR] France ..... 91 08137

[51] Int. Cl.[5] ..... H01P 1/20

[52] U.S. Cl. ..... 333/208; 333/21 R; 333/21 A; 333/126; 333/135

[58] Field of Search ..... 333/21 A, 21 R, 33, 333/126, 137, 135, 157, 129, 160, 242, 248, 251, 208

[56] References Cited

U.S. PATENT DOCUMENTS

| | | | |
|---|---|---|---|
| 2,719,274 | 9/1955 | Luhrs | 333/258 |
| 4,724,408 | 2/1988 | Igarashi | 333/212 |
| 4,725,795 | 2/1988 | Ajioka et al. | 333/126 |
| 4,780,694 | 10/1988 | Kich et al. | 333/208 |
| 4,881,051 | 11/1989 | Tang et al. | 333/208 |
| 4,906,951 | 3/1990 | Moeller | 333/21 A |
| 4,920,351 | 4/1990 | Bartlett et al. | 343/756 |
| 5,184,098 | 2/1993 | Kich et al. | 333/208 |

FOREIGN PATENT DOCUMENTS

| | | |
|---|---|---|
| 3326829A1 | 2/1985 | Fed. Rep. of Germany . |
| 3613474A1 | 10/1987 | Fed. Rep. of Germany . |
| 582856 | 11/1946 | United Kingdom . |
| 2166297A | 4/1986 | United Kingdom . |

OTHER PUBLICATIONS

B. Ladanyi-Turoczy, "Design of a Superelliptic Waveguide Polarizer", Conference Proceedings, 16th European Microwave Conference, Dublin, Ireland, Sep. 1986, pp. 441-446.

*Primary Examiner*—Raymond A. Nelli
*Attorney, Agent, or Firm*—Kinney & Lange

[57] ABSTRACT

A device for the filtering of electromagnetic waves propagating in a main rotational symmetrical waveguide element comprising at least one filtering section constituted of a rectangular waveguide section inserted in being spliced into the main waveguide element, each transition between said main waveguide element and each of said filtering sections being made by metal walls which are substantially perpendicular to said axis of symmetry, the number and the geometrical and dimensional characteristics of the filtering sections being chosen so as to constitute a filter with a pre-determined filtering profile. The device can be applied especially in dual band filtering, for example for the making of dual band or bi-polarization duplexers.

9 Claims, 3 Drawing Sheets

DEVICE FOR THE FILTERING OF ELECTROMAGNETIC WAVES PROPAGATING IN A ROTATIONAL SYMMETRICAL WAVEGUIDE, WITH INSERTED RECTANGULAR FILTERING WAVEGUIDE SECTIONS

BACKGROUND OF THE INVENTION

1. Field of the Invention

The field of the invention is that of filtering in electromagnetic waveguides. More specifically, the invention relates to a device for the filtering of waves propagating in rotational symmetrical waveguides, such as the circular waveguides or coaxial waveguides used in $TE_{11}$ mode.

The invention can be applied in particular to dual band filters. A major use of this invention is indeed the making of dual band and bi-polarization duplexers, notably when the ports of the duplexers are in the same rectangular guide standard. This is, for example, the case of the 10.95–12.5 GHz and 14–14.5 GHz bands in the WR 75 waveguide. As a general rule, the horizontal and vertical polarizations of these duplexers are not identical in the two frequency bands considered.

2. Description of the Prior Art

FIG. 1 shows a schematic view of a known type of duplexer such as this. The high (for example 14–14.5 GHz) band port 11 and the low (for example 10.95–14.5 GHz) band port 12 are constituted by rectangular waveguides. The output 13 towards the radiating element is constituted by a circular waveguide.

For the low band, the excitation is achieved by a coupling, by means of a slot in the duplexer 14, between the rectangular guide and the circular guide. If the wave is to be propagated towards the radiating element and not towards the high band port 11 constituted by a rectangular guide, it is necessary to place a rectangular-to-circular transition 15 and a polarization filter 16 between the high band 11 port and the duplexer 14.

There already exists several known types of polarization, such as those shown in FIGS. 2 and 3. FIG. 2 shows a filter with metal plate 21, and FIG. 3 shows a filter with metal wires 31, 32, 33. These metal elements 21 or 31, 32, 33, selectively placed in the waveguide 22, enable the elimination of a polarization, hence the elimination of a given frequency band.

An error of one degree in the positioning of this plate 21 or of these wires 31, 32, 33 causes a maximum decoupling (transmission of the electromagnetic wave from the port 11 to the port 12) of 35 dB, which is generally insufficient. In mechanical terms, therefore, the making of these devices calls for high precision in the placing and fixing of the plate 21 or of the wires 31, 32, 33 to the interior of the circular guide 22. Furthermore, the manufacture of such filters calls for several successive and delicate steps.

SUMMARY OF THE INVENTION

It is an aim of the invention, notably, to overcome the drawbacks of these prior art filters.

More specifically, an aim of the invention is to provide a filtering device for rotational symmetrical waveguides that is easy to make from the mechanical viewpoint, and notably a filtering device that does not call for the mounting of elements inside the waveguide.

Another aim of the invention is to provide a filtering device such as this providing a satisfactory decoupling of at least 40 to 45 dB.

A particular object of the invention is to provide a filtering device such as this enabling a total reflection of one polarization and the total transmission of the other polarization, in a given frequency band.

An additional object of the invention is to provide a device such as this, making it possible to pass from a linear polarization to a circular polarization.

These aims, as well as others that shall appear hereinafter, are achieved according to the invention by means of a device for the filtering of electromagnetic waves propagating in a main rotational symmetrical waveguide element extending along an axis of symmetry, wherein said device comprises at least one filtering section constituted of a rectangular waveguide section inserted in being spliced into said main waveguide element, each transition between said main waveguide element and each of said filtering sections being made by metal walls which are substantially perpendicular to said axis of symmetry, the number and the geometrical and dimensional characteristics of said filtering sections being chosen so as to constitute a filter with a pre-determined filtering profile.

These filtering rectangular waveguide sections introduce a disymmetry in the main waveguide. Depending on their geometrical characteristics, number and spacing, they can be used, for example, to obtain a filter with a reflection coefficient close to 1 for one of the polarizations and a reflection coefficient close to zero for the other polarization, in a given frequency band. For other dimensions, it is also possible that there is no longer any overlapping between the filtered band and the pass band of the filter.

The transition between each section is abrupt (i.e. substantially perpendicular to the axis of symmetry of the main waveguide). No particular tapered transition or matching element is needed between the main waveguide and the filtering sections. These sudden transitions are, naturally, closed by a metal conductor on the part of the transition where both cross-sections of the main waveguide and of the rectangular section do not coincide (if not, the waves would no longer be guided).

In a preferred embodiment, said main waveguide element is of the circular waveguide type or of the coaxial waveguide type working in $TE_{11}$ mode.

In a preferred way, the width of said rectangular waveguide sections is greater than or equal to the diameter of said main waveguide element.

In an advantageous embodiment of the invention, said main waveguide element and said rectangular waveguide sections are centered on said axis of symmetry.

Advantageously, the device of the invention comprises a set of at least two sections of rectangular waveguide sections inserted at locations spaced out in said main waveguide element.

It can be seen, in fact, that the quality of the filtering is a function of the number of rectangular waveguides used. It will be noted, furthermore, that it is quite possible to envisage the use of the rectangular sections according to the invention in combination with other known types of elements such as metal plate filters or metal wire filters.

In an advantageous embodiment, the number and the geometrical and/or dimensional characteristics of said rectangular waveguide sections are determined by modal analysis.

The device of the invention can be used notably for at least one of the following applications:

- the filtering of a frequency band in a circular waveguide element in $TE_{11}$ mode;
- the filtering of a horizontal or vertical polarization in a circular waveguide element in $TE_{11}$ mode;
- the conversion of a linear polarization into a circular polarization.

When the device of the invention is designed for the conversion of a linear polarization into a circular polarization, said linear polarization is advantageously parallel to a diagonal of the cross-section of said rectangular waveguide sections.

The invention also relates to duplexers implementing a filtering device as described here above.

BRIEF DESCRIPTION OF THE DRAWINGS

Other features and advantages of the invention shall appear from the following description of a preferred embodiment of the invention, given by way of a non-restrictive illustration, and from the appended drawings, of which.

DETAILED DESCRIPTION OF THE INVENTION

The invention relates therefore to a filtering device, made by the insertion of rectangular waveguide sections introducing a dissymmetry into a main rotational symmetrical waveguide.

In the embodiment described here below in detail, the main waveguide is a circular waveguide.

It is clear, however, that the scope of the invention can easily be broadened to include other types of waveguides. Thus, the main waveguide may also be, for example, a coaxial waveguide in $TE_{11}$ mode. It is also possible, in conjunction with rectangular filtering elements according to the invention, to use guide elements of a known type, called rotational symmetrical elements, provided that their symmetry is eliminated, for example by placing an dielectrical plate along one of the polarizations.

Figure 4:
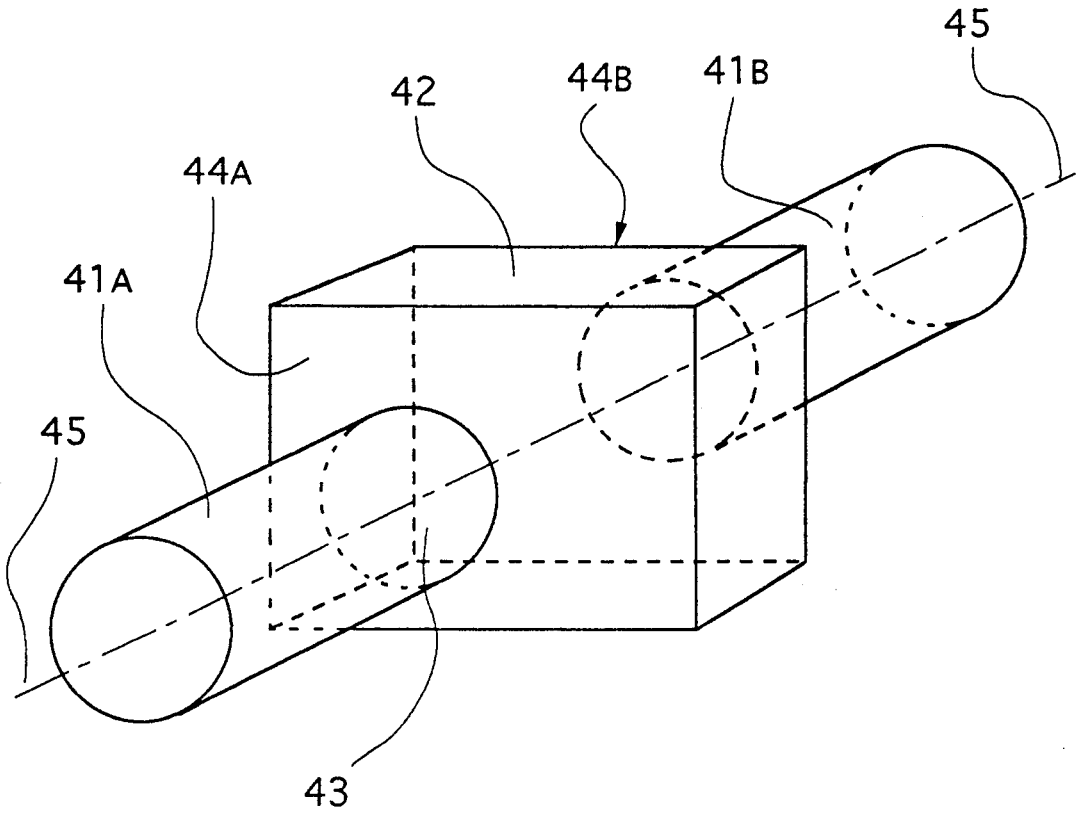
FIG. 4 shows a schematic view of a filtering element according to the invention, with a rectangular section inserted in being spliced into a circular main waveguide.

FIG. 4 shows a schematic view in perspective of a filtering element according to the invention. The circular main waveguide is separated into two parts $\mathbf{41}_A$ and $\mathbf{41}_B$ between which a rectangular waveguide section 42 is inserted.

Figure 6A:
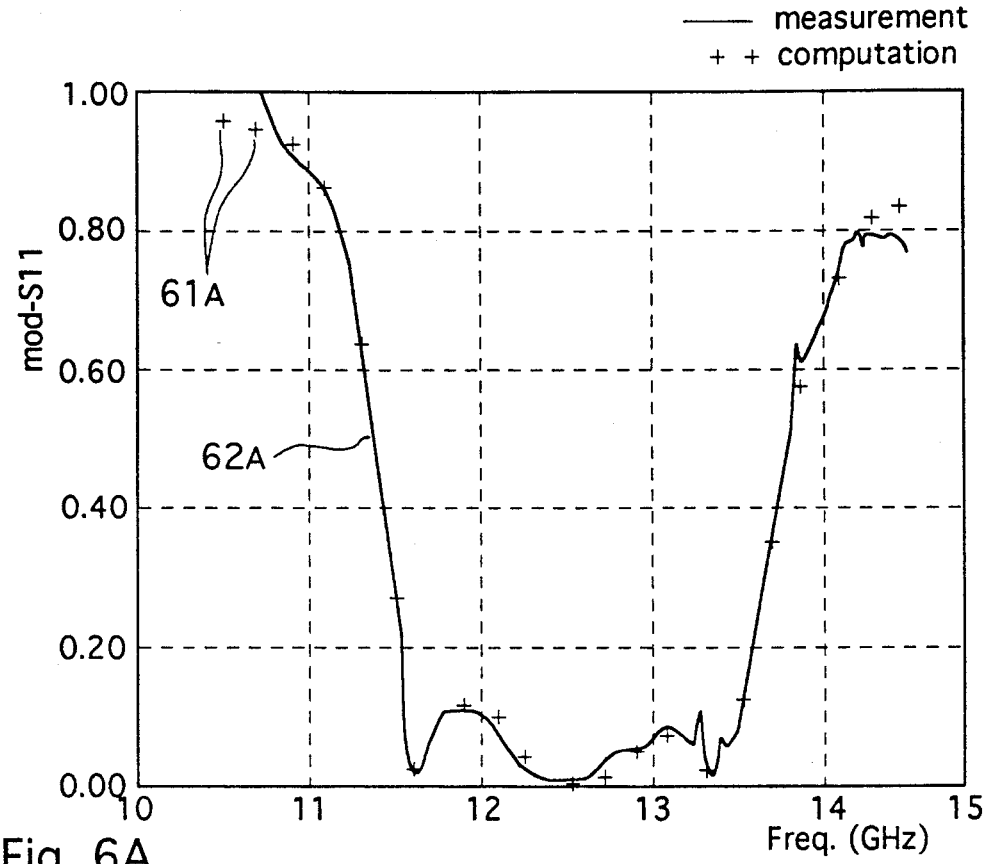
FIGS. 6A to 6B illustrate the reflection coefficients of the device of FIG. 5, when the polarizations of the $TE_{11}$ mode in circular guide operation are respectively parallel and perpendicular to the small side of the rectangular waveguide sections.
Figure 6B:
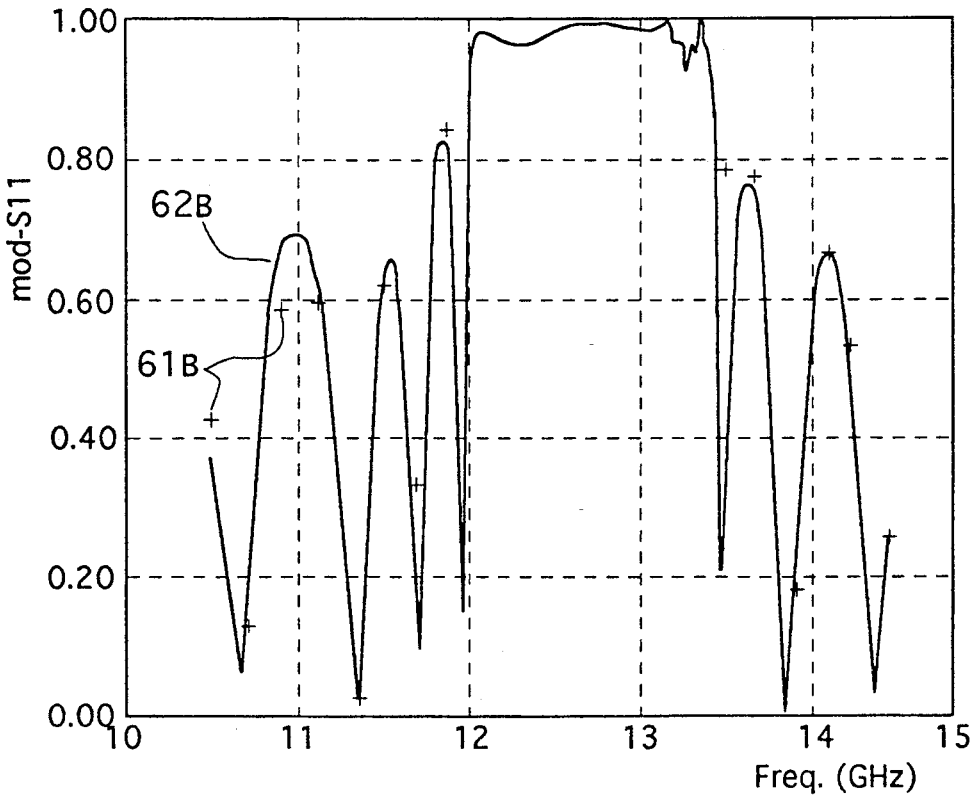

By associating several elements as shown in FIG. 4, it is possible to make a precise and efficient filter, as illustrated by FIGS. 6A and 6B shown further below.

The main waveguide $\mathbf{41}_A$ and $\mathbf{41}_B$ is joint to the rectangular section 42 with walls $\mathbf{44}_A$ and $\mathbf{44}_B$, which close the part of the transition where both cross-sections of the main waveguide and the rectangular section do not coincide.

According to the invention, the walls $\mathbf{44}_A$ and $\mathbf{44}_B$ should be abrupt. In other words, the walls $\mathbf{44}_A$ and $\mathbf{44}_B$ are substantially perpendicular to the axis of symmetry 45 of the main waveguide $\mathbf{41}_A$, $\mathbf{41}_B$. No transition element is inserted. These walls $\mathbf{44}_A$ and $\mathbf{44}_B$ are metallic. Naturally they cannot be completely open (i.e. they should not be in the presence of air) nor should they be made of a dielectric. Otherwise, the wave would escape and would no longer be guided.

Figure 2:
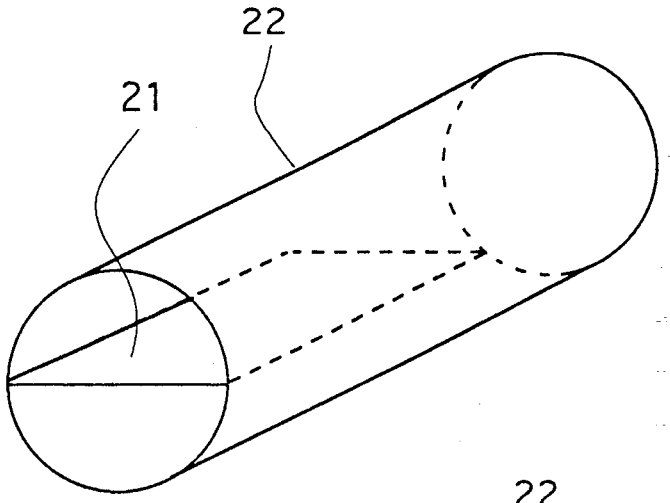
FIGS. 2 and 3 show two known types of polarization filters, respectively a metal plate filter and a metal wire filter, mounted inside the waveguide and already described in the introduction.
Figure 3:
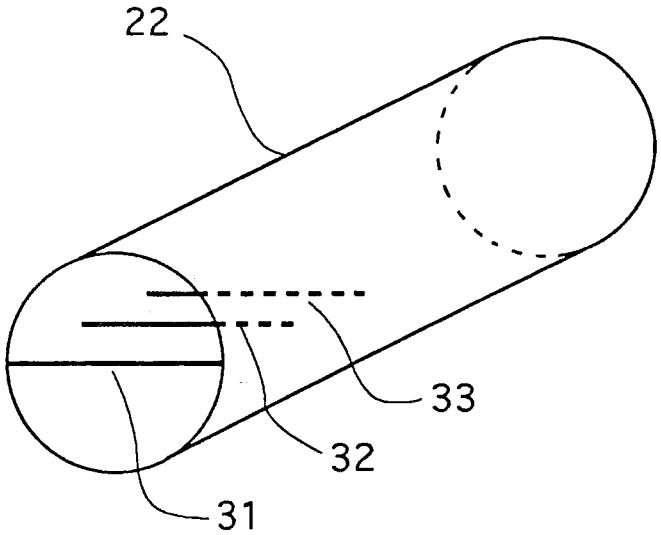

It is seen, therefore, that the machining of a filter such as this is highly simplified as compared with the filters shown in FIGS. 2 and 3. Indeed, there is no element to be placed within the circular guide, nor is there any particular transition to be defined. It is enough to fix the different sections to one another or else to make the filter by means of two half-shells.

Advantageously, the circular guide $\mathbf{41}_A$ is placed at the center of the rectangular guide 42, and the cross-section 43 common to the two waveguides is circular. In this case, the height of the rectangular guide 42 is thus at least equal to the diameter of the circular guide $\mathbf{41}_A$.

In the embodiment described, the sections $\mathbf{41}_A$, 42, $\mathbf{41}_B$ are all centered on a same longitudinal axis which is the axis of symmetry 45. In other applications, however, it is possible to arrange for an offsetting of these sections in relation to this axis.

The geometry of the rectangular guide section (height, width and thickness) as well as the number of sections and the spacing between these sections are a function of the characteristics desired for the filter. These different parameters may be determined, for example, according to the modal method.

There is no limit on the dimensions of the sides of the rectangular guide, so long as these dimensions are greater than the diameter of the circular waveguide. The pass band may therefore be high (for example of the order of 10%).

Figure 1:
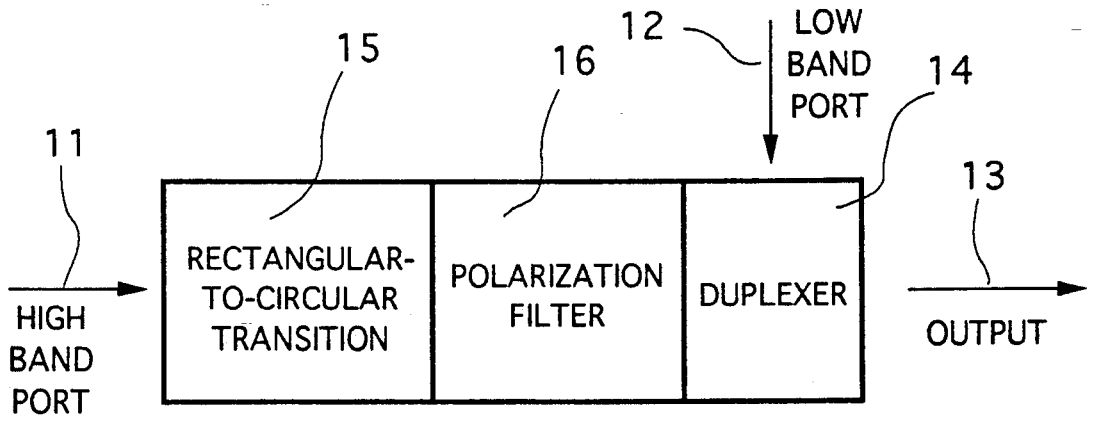
FIG. 1 shows a schematic view of a duplexer capable of using a filtering device according to the invention.

As already mentioned, the invention finds preferred application in dual band and bi-polarization duplexers such as those shown schematically in FIG. 1. In this case, the polarization filter 16 should totally transmit one of the polarizations and should reflect the other polarization. The example, with estimated values, described here below relates to a filter such as this, for the 12–13 GHz frequency band.

Since the dimensions of the rectangular waveguide are greater than the diameter of the circular guide, the polarization of the wave getting propagated in the circular guide may be placed along the diagonal of the rectangular guide.

Since the pass band is high, it is necessary to connect a circular guide to the output (13) of the polarizer.

It is furthermore clear that the device of the invention can find numerous other applications, both in filtering and in polarization.

Figure 5:
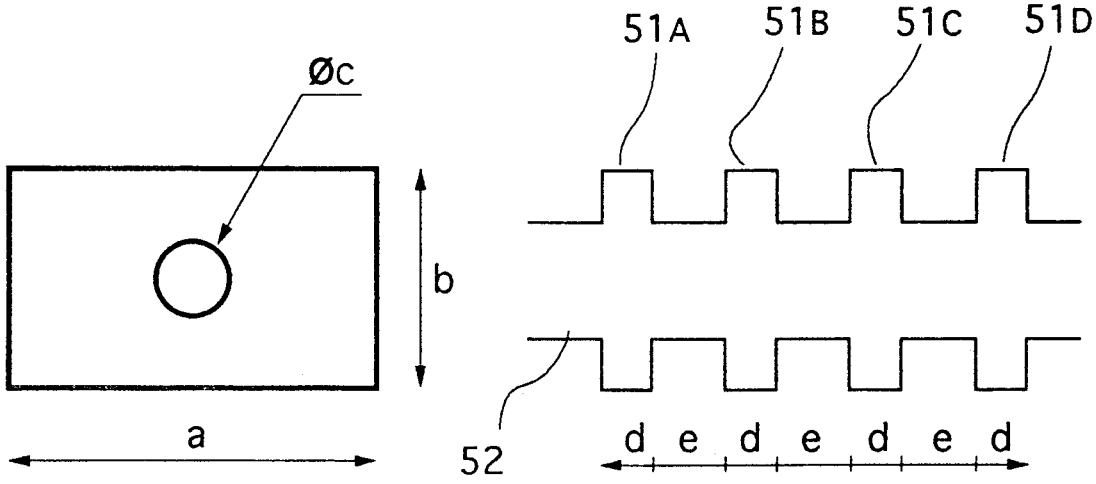
FIG. 5 shows the dimensions of the filtering device described as a preferred embodiment, comprising four filtering elements as shown in FIG. 4.

FIG. 5 therefore shows the dimensions of a filter, the performance characteristics of which are illustrated by FIGS. 6A and 6B. This filter is constituted by four rectangular waveguide sections $\mathbf{51}_A$ to $\mathbf{51}_D$, inserted in the circular waveguide 52.

The circular waveguide has a diameter $c = 17.5$ mm.

The rectangular sections have the following dimensions:

width: a=28.5 mm;

height: b=21.26 mm;

length: d=10 mm.

The spacing between two rectangular sections is: e=15.8 mm.

The excitations are done in $TE_{11}$ mode in the circular waveguide 52.

It must be noted that this embodiment does not correspond to an optimized filter, but is aimed at enabling the validation of a software computation, as can be seen in FIGS. 6A and 6B.

FIG. 6A shows the curve $\mathbf{61}_A$ of the reflection coefficient of the filtering device of FIG. 5 when the polarization in $TE_{11}$ mode in a circular guide is perpendicular to the small side of the rectangular sections $\mathbf{51}_A$ to $\mathbf{51}_D$.

In this case, the $TE_{11}$ mode is completely transmitted on the 12-13 GHz frequency band, the reflection coefficient being close to 0.

The purpose of this filter, which is given by way of an example, is to give a filtering result that is as close as possible to the result that is fixed theoretically by computation for a given application, represented by a series $\mathbf{61}_A$ of + signs.

The curve $\mathbf{62}_A$ of measured reflection shows that it is possible, with the device of the invention, to enforce the filtering characteristics with precision. It is observed, in effect, that the curve $\mathbf{62}_A$ is very close to the desired results $\mathbf{61}_A$.

FIG. 6B shows the reflection coefficient of the same device, when the polarization of the $TE_{11}$ mode in the circular guide is parallel to the small side of the rectangular sections $\mathbf{51}_A$ to $\mathbf{51}_D$. The $TE_{11}$ mode is then reflected totally for the 12-13 GHz frequency band. Indeed, the reflection coefficient is close to 1 and the transmission is therefore zero.

Once again, it is observed that the measured curve $\mathbf{62}_B$ very closely follows the computed desired characteristics $\mathbf{61}_B$.

With this filtering device, decouplings of the order of 40 to 45 dB are obtained. This corresponds to the values obtained with the standard wire filters or plate filters, when these elements are well positioned. The invention thus provides for the making of filters that are at least as efficient as those of known types, and for making them far more easily from the manufacturing point of view.

The geometrical characteristics of this filter have been determined according to the modal method. Other methods of computation can also be determined. Advantageously, the experimental precision tuning of a filter is done by means of an optimizing software implementing, for example, this modal method.

The invention is naturally not limited to the embodiment described here above. It is indeed possible to make filters that use rectangular sections with different geometries. These different sections may be attached or not attached, and the spaces between them may have fixed or variable sizes.

It is also possible to use rectangular sections according to the invention in conjunction with standard filtering devices, for example metal plate or metal wire filtering devices.

Apart from the filtering (horizontal or vertical) in a circular guide in $TE_{11}$ mode, when the two linear polarizations coexist, the device of the invention can also be used for the filtering of a frequency band in a circular guide in $TE_{11}$ mode, in the case of a rectilinear polarization.

Yet another application of the device of the invention lies in the making of polarizers to convert a linear polarization into a circular polarization.

A polarizer is a device that enables changing from a linear polarization to a circular polarization. In the case of the invention, the linear polarization should be parallel to a diagonal of the rectangular guide. At output, there is then obtained a circular polarization, since the horizontally polarized waves and the circularly polarized waves do not have the same phase speed in the rectangular guide. A complete polarizer may be made by associating several elements according to the invention, or else by associating them with other already known elements.

What is claimed is:

1. A device for filtering electromagnetic waves comprising:

an input circular waveguide element having an axis of symmetry perpendicular to a first circular end, wherein the input circular waveguide element receives electromagnetic waves;

a rectangular waveguide element connected to the input circular waveguide element having a first and a second rectangular end perpendicular to the axis of symmetry;

an output circular waveguide element connected to a side of the rectangular waveguide element opposite the input circular waveguide element, the output circular waveguide element having a second circular end perpendicular to the axis of symmetry, where the output circular waveguide element receives filtered electromagnetic waves;

wherein the first rectangular end of the rectangular waveguide element is closed with a first metal wall and the second rectangular end of the rectangular waveguide element is closed with a second metal wall;

wherein the first and second circular ends correspond to circular openings made in the first and second metal walls; and wherein a diameter of the input circular waveguide element is equal to a diameter of the output circular waveguide element.

2. The device according to claim 1, wherein the device may be used in at least the following applications:

to filter a frequency band in a circular waveguide element in $TE_{11}$ mode; and to filter a horizontal or a vertical polarization in the circular waveguide element in $TE_{11}$ mode; and to convert a linear polarization into a circular polarization.

3. The device according to claim 1, wherein the device is used with a dual band duplexer.

4. A device for filtering electromagnetic waves comprising:

an input circular waveguide element having an axis of symmetry perpendicular to a first circular end, the input circular waveguide element receiving electromagnetic waves;

a plurality of rectangular waveguide elements having a first and a second rectangular end perpendicular to the axis of symmetry, wherein at least one rectangular waveguide element is connected to the input circular waveguide element;

an intermediate circular element wherein the axis of symmetry is perpendicular to a first and a second circular end;

an output circular waveguide element connected to a second of the plurality of rectangular waveguide elements wherein the axis of symmetry is perpendicular to a second circular end and wherein the output circular waveguide element filters electromagnetic waves;

wherein the rectangular ends of the plurality of rectangular waveguide elements is closed with a metal wall, each of the metal walls having a circular opening which corresponds to the circular ends of the input, intermediate and output circular waveguide elements; and wherein the input, intermediate and output circular waveguide elements have identical diameters.

5. The device according to claim 4, wherein the device may be used in at least the following applications:

to filter a frequency band in a circular waveguide element in $TE_{11}$ mode; and to filter a horizontal or a vertical polarization in the circular waveguide element in $TE_{11}$ mode; and to convert a linear polarization into a circular polarization.

6. The device according to claim 4, wherein the device is used with a dual band duplexer.

7. A device for filtering electromagnetic waves comprising:

an input coaxial waveguide element in $TE_{11}$ mode having an axis of symmetry perpendicular to a first circular end, the input coaxial waveguide element receiving electromagnetic waves;

a rectangular waveguide element connected to the input circular waveguide element oriented such that the axis of symmetry is perpendicular to a first and second rectangular end;

an output coaxial waveguide element in $TE_{11}$ mode connected to the rectangular waveguide element wherein the axis of symmetry is perpendicular to a second circular end, and wherein the output coaxial waveguide element filters electromagnetic waves;

wherein the first and second rectangular ends are closed with a first and second metal wall, respectively;

the first and second circular ends correspond to circular openings made in the first and second metal walls; and the input coaxial waveguide element has a diameter which is equal to a diameter of the output coaxial waveguide element.

8. The device according to claim 7, wherein the device may be used in at least the following applications:

to filter a frequency band in a circular waveguide element in $TE_{11}$ mode; and to filter a horizontal or a vertical polarization in the circular waveguide element in $TE_{11}$ mode; and to convert a linear polarization into a circular polarization.

9. The device according to claim 7, wherein the device is used with a dual band duplexer.

* * * * *

UNITED STATES PATENT AND TRADEMARK OFFICE

CERTIFICATE OF CORRECTION

PATENT NO. : 5,309,128

DATED : May 3, 1994

INVENTOR(S) : CHRISTIAN M. SABATIER

It is certified that error appears in the above-identified patent and that said Letters Patent is hereby corrected as shown below:

Col. 1, line 42, delete "exists", insert --exist--

Signed and Sealed this

Thirtieth Day of August, 1994

*Attest:*

*Attesting Officer*

Bruce Lehman

BRUCE LEHMAN

*Commissioner of Patents and Trademarks*